US011801965B2

(12) United States Patent
Obana

(10) Patent No.: US 11,801,965 B2
(45) Date of Patent: Oct. 31, 2023

(54) VERTICALLY-CRUSHABLE CONTAINER AND MULTI-WALL CONTAINER

(71) Applicant: SHISEIDO COMPANY, LTD., Tokyo (JP)

(72) Inventor: Takakazu Obana, Tokyo (JP)

(73) Assignee: SHISEIDO COMPANY, LTD., Tokyo (JP)

( * ) Notice: Subject to any disclaimer, the term of this patent is extended or adjusted under 35 U.S.C. 154(b) by 0 days.

(21) Appl. No.: 17/251,340

(22) PCT Filed: Jun. 12, 2019

(86) PCT No.: PCT/JP2019/023332
§ 371 (c)(1),
(2) Date: Dec. 11, 2020

(87) PCT Pub. No.: WO2019/240188
PCT Pub. Date: Dec. 19, 2019

(65) Prior Publication Data

US 2021/0245913 A1 Aug. 12, 2021

(30) Foreign Application Priority Data

Jun. 13, 2018 (JP) ..... 2018-113138

(51) Int. Cl.
*B65D 1/02* (2006.01)
*B65D 47/08* (2006.01)
(Continued)

(52) U.S. Cl.
CPC ..... *B65D 1/0292* (2013.01); *B05B 11/026* (2023.01); *B05B 11/1001* (2023.01);
(Continued)

(58) Field of Classification Search
CPC ..... B65D 1/0292; B65D 1/0207; B65D 47/0838; B65D 81/2076; B65D 83/0055;
(Continued)

(56) References Cited

U.S. PATENT DOCUMENTS 687,790 A * 12/1901 Scales ..... B65D 35/12 222/92
3,335,913 A 8/1967 Bouet
(Continued)

FOREIGN PATENT DOCUMENTS

JP H05-094155 U 12/1993
JP H09-242987 9/1997
(Continued)

OTHER PUBLICATIONS

International Search Report for PCT/JP2019/023332 dated Sep. 10, 2019.
(Continued)

*Primary Examiner* — Frederick C Nicolas
(74) *Attorney, Agent, or Firm* — IPUSA, PLLC

(57) ABSTRACT

A container includes a bottom wall and a side wall. Multiple vertically-crushable units are formed in the side wall, each unit of the multiple units includes mountain fold lines formed by sides of parallelograms and valley fold lines formed by diagonal lines of the parallelograms, and the multiple units are stacked in tiers such that each pair of the parallelograms in upper and lower tiers have a common lower/upper side and the parallelograms in the upper and lower tiers alternately become line-symmetrical with respect to the common lower/upper side.

11 Claims, 11 Drawing Sheets

(51) Int. Cl.

| | |
|---|---|
| ***B65D 81/20*** | (2006.01) |
| ***B65D 83/00*** | (2006.01) |
| ***B05B 11/02*** | (2023.01) |
| ***B05B 11/10*** | (2023.01) |
| *B05B 11/00* | (2023.01) |

(52) U.S. Cl.
CPC ..... *B05B 11/1047* (2023.01); *B65D 1/0207* (2013.01); *B65D 47/0838* (2013.01); *B65D 81/2076* (2013.01); *B65D 83/0055* (2013.01); *B05B 11/0037* (2013.01); *B05B 11/0038* (2018.08)

(58) Field of Classification Search
CPC ..... B05B 11/0037; B05B 11/0038; B05B 11/00412; B05B 11/3001; B05B 11/3047; B05B 11/1047; B05B 11/026; B05B 11/1001
See application file for complete search history.

(56) References Cited

U.S. PATENT DOCUMENTS

| | | | | |
|---|---|---|---|---|
| 3,791,557 | A | 2/1974 | Venus, Jr. | |
| 3,838,796 | A | 10/1974 | Cohen | |
| 3,876,115 | A | 4/1975 | Venus, Jr. et al. | |
| 4,062,475 | A | 12/1977 | Harris et al. | |
| 4,322,020 | A | 3/1982 | Stone | |
| 4,492,313 | A * | 1/1985 | Touzani | B65D 1/0292 426/111 |
| 4,790,361 | A * | 12/1988 | Jones | B65D 1/0292 220/666 |
| 4,797,309 | A * | 1/1989 | Kammerer | B65D 75/5811 222/541.6 |
| 5,102,010 | A * | 4/1992 | Osgar | B65D 47/36 222/541.9 |
| 5,201,438 | A * | 4/1993 | Norwood | B65D 1/0292 220/666 |
| 5,238,150 | A | 8/1993 | Williams | |
| 5,279,447 | A | 1/1994 | Petschek | |
| 5,310,068 | A * | 5/1994 | Saghri | B65D 23/00 220/666 |
| 5,333,761 | A * | 8/1994 | Davis | B65D 1/0292 222/215 |
| 5,348,173 | A * | 9/1994 | Norwood | B65D 1/0292 220/666 |
| 5,642,838 | A | 7/1997 | Stoody | |
| 5,875,936 | A | 3/1999 | Turbett et al. | |
| 5,960,993 | A * | 10/1999 | Mitsui | B65D 33/02 222/105 |
| 6,223,932 | B1 * | 5/2001 | Usui | B65D 1/0292 220/666 |
| 6,598,755 | B1 * | 7/2003 | Pedulla | B65D 1/0292 215/381 |
| 6,601,732 | B1 * | 8/2003 | Rooney | B32B 15/20 222/105 |
| 6,648,244 | B2 | 11/2003 | Yu | |
| 6,840,164 | B2 * | 1/2005 | Eastman | A23B 4/28 99/345 |
| 7,140,518 | B2 | 11/2006 | Wang | |
| 7,661,565 | B2 * | 2/2010 | Jackman | B65D 51/20 222/541.6 |
| 7,866,500 | B1 * | 1/2011 | Peggs | B65D 41/04 220/666 |
| 7,963,955 | B2 * | 6/2011 | Freund | B65D 83/0061 222/105 |
| 8,302,813 | B2 * | 11/2012 | Chen | B67D 7/0288 222/541.2 |
| 8,550,300 | B2 | 10/2013 | Lee et al. | |
| 8,596,448 | B2 * | 12/2013 | Sempe | A45C 7/0036 220/666 |
| 8,695,850 | B2 * | 4/2014 | Bowman | B65D 25/48 222/90 |
| 9,296,508 | B2 * | 3/2016 | Kanfer | B65D 1/0292 |
| 10,974,885 | B2 | 4/2021 | Yamauchi et al. | |
| 2003/0006240 | A1 * | 1/2003 | Higuchi | B65D 55/16 220/667 |
| 2003/0075562 | A1 * | 4/2003 | Gerenraich | B65D 23/12 222/95 |
| 2004/0040971 | A1 * | 3/2004 | Athalye | B65D 5/3628 220/666 |
| 2005/0017015 | A1 * | 1/2005 | Higuchi | B65D 1/0292 220/666 |
| 2009/0014471 | A1 | 1/2009 | Lin | |
| 2011/0036806 | A1 * | 2/2011 | Gregg | B65D 1/0292 215/382 |
| 2012/0227860 | A1 * | 9/2012 | Jeremiah | G06Q 20/3278 220/666 |
| 2013/0193164 | A1 * | 8/2013 | Tom | B65D 37/00 222/105 |
| 2013/0200110 | A1 | 8/2013 | Lee et al. | |
| 2014/0151396 | A1 | 6/2014 | Stehli, Jr. et al. | |
| 2014/0166650 | A1 * | 6/2014 | Kanfer | B05B 11/00414 220/6 |
| 2016/0023823 | A1 * | 1/2016 | Barron | B65D 5/747 156/219 |
| 2017/0173615 | A1 | 6/2017 | Toh et al. | |
| 2022/0062929 | A1 | 3/2022 | Goettke | |

FOREIGN PATENT DOCUMENTS

| | | |
|---|---|---|
| JP | H11-043150 | 2/1999 |
| JP | H11-130072 | 5/1999 |
| JP | H11-342948 | 12/1999 |
| JP | 2000-007031 | 1/2000 |
| JP | 2003-128041 | 5/2003 |
| JP | 3123074 U | 7/2006 |
| JP | 2008-213854 | 9/2008 |
| JP | 2010-126215 | 6/2010 |
| JP | 2011-011781 | 1/2011 |
| JP | 4769976 | 9/2011 |
| JP | 2013-540080 | 10/2013 |
| JP | 2015030526 | 2/2015 |
| TW | 201228897 | 7/2012 |
| WO | 2008/091149 | 7/2008 |
| WO | 2017/082115 | 5/2017 |

OTHER PUBLICATIONS

Ichiro Hagiwara et al., "Optimization for Crush Characteristics of Cylindrical Origami Structure Using Reversed Spiral Model", JSME Proceedings (A), vol. 70, No. 689, Jan. 2004, pp. 36-42, with English abstract.

Ichiro Hagiwara et al., "Consideration on Crush Characteristics of Cylindrical Structures using Origami Engineering", Transactions of Society of Automotive Engineers of Japan, vol. 34, No. 4, Oct. 2003, pp. 145-149, with English abstract.

International Search Report for PCT/JP2019/023331 dated Sep. 10, 2019.

Extended European search report issued in counterpart European Patent Application No. 19820045.3, dated Feb. 23, 2022.

Extended European Search Report issued in counterpart European Patent Application No. 19819511.7, dated Feb. 9, 2022.

U.S. office action issued in the counterpart U.S. Appl. No. 15/734,000 dated May 17, 2022.

U.S. office action issued in the counterpart U.S. Appl. No. 15/734,000 dated Feb. 23, 2023.

* cited by examiner

VERTICALLY-CRUSHABLE CONTAINER AND MULTI-WALL CONTAINER

TECHNICAL FIELD

The present invention relates to a vertically-crushable container and a multi-wall container including a vertically-crushable inner container.

BACKGROUND ART

In recent years, various technologies for crushing containers have been proposed. For example, Patent Document 1 proposes a trigger bottle that includes a bellows side wall and shrinks in the vertical direction such that the volume of the bottle decreases as it is used.

Also, Patent Document 2 proposes forming valley lines, ridge lines, and a convex surface and a concave surface between one and the other of the valley lines and the ridge lines in a body of a cylindrical container used for a beverage container such that the volume of the container can be reduced for disposal by twisting the upper end and the lower end.

Further, Patent Document 3 proposes a PET bottle that is formed by connecting the upper, lower, right, and left sides of multiple parallelograms to each other such that the sides and diagonal lines become valley lines or ridge lines and by vertically stacking the parallelograms.

RELATED-ART DOCUMENTS

Patent Documents

[Patent Document 1] Japanese Unexamined Patent Application Publication No. H11-130072

[Patent Document 2] Japanese Patent No. 4769976

[Patent Document 3] Japanese Unexamined Patent Application Publication No. H11-342948

Non-Patent Documents

[Non-Patent Document 1] Ichiro Hagiwara et al., "Optimization for Crush Characteristics of Cylindrical Origami Structure Using Reversed Spiral Model", JSME Proceedings (A), Vol. 70, No. 689, January, 2004, pp. 36-42

[Non-Patent Document 2] Ichiro Hagiwara et al., "Consideration on Crush Characteristics of Cylindrical Structures using Origami Engineering", Transactions of Society of Automotive Engineers of Japan, Vol. 34, No. 4, October, 2003, pp. 145-149

DISCLOSURE OF INVENTION

Problems to be Solved by the Invention

However, Patent Document 1 is based on an assumption that the container is crushed by applying an external load after use; and if the container is pressed downward while the content remains, the crushed shape is restored upward due to an elastic force of the bellows side wall. Accordingly, air may enter the container each time the container is used.

Also, because the container described in each of Patent Document 2 and Patent Document 3 is crushed by twisting the upper end and the lower end, it is not possible to reduce the volume with one hand. In addition, due to the twisting, the outline of the outer shape of the bottle is not maintained when the bottle is crushed.

Further, when multiple parallelograms having a common upper/lower side are stacked in tiers in the vertical direction as described in Patent Document 3 to form a container that requires twisting as described in Patent Documents 2 and 3, the ridge lines formed of the sloping sides of the parallelograms rotate (or shift) in the lateral direction of the side wall as the parallelograms are stacked. For this reason, multiple discontinuous ridge lines are present on a vertical plane (a vertical line corresponding to the generatrix) on a projection plane of the container. This makes it not possible to create a split mold and complicates the manufacturing process.

In view of the above problems, one object of the present invention is to provide a container that can be vertically crushed without greatly twisting the upper end and the lower end of the container.

Means for Solving the Problems

To solve the above problems, an aspect of the present invention provides a container including a bottom wall and a side wall. Multiple vertically-crushable units are formed in the side wall, each unit of the multiple units includes mountain fold lines formed by sides of parallelograms and valley fold lines formed by diagonal lines of the parallelograms, and the multiple units are stacked in tiers such that each pair of the parallelograms in upper and lower tiers have a common lower/upper side and the parallelograms in the upper and lower tiers alternately become line-symmetrical with respect to the common lower/upper side.

Advantageous Effect of the Invention

An aspect of this disclosure makes it possible to shrink and reduce the volume of a container without greatly twisting the upper end and the lower end of the container.

DESCRIPTION OF EMBODIMENTS

Embodiments of the present invention are described below with reference to the accompanying drawings. Throughout the drawings, the same reference number is assigned to the same component, and repeated descriptions of the same component may be omitted.

Example of Configuration of Container

Figure 1:
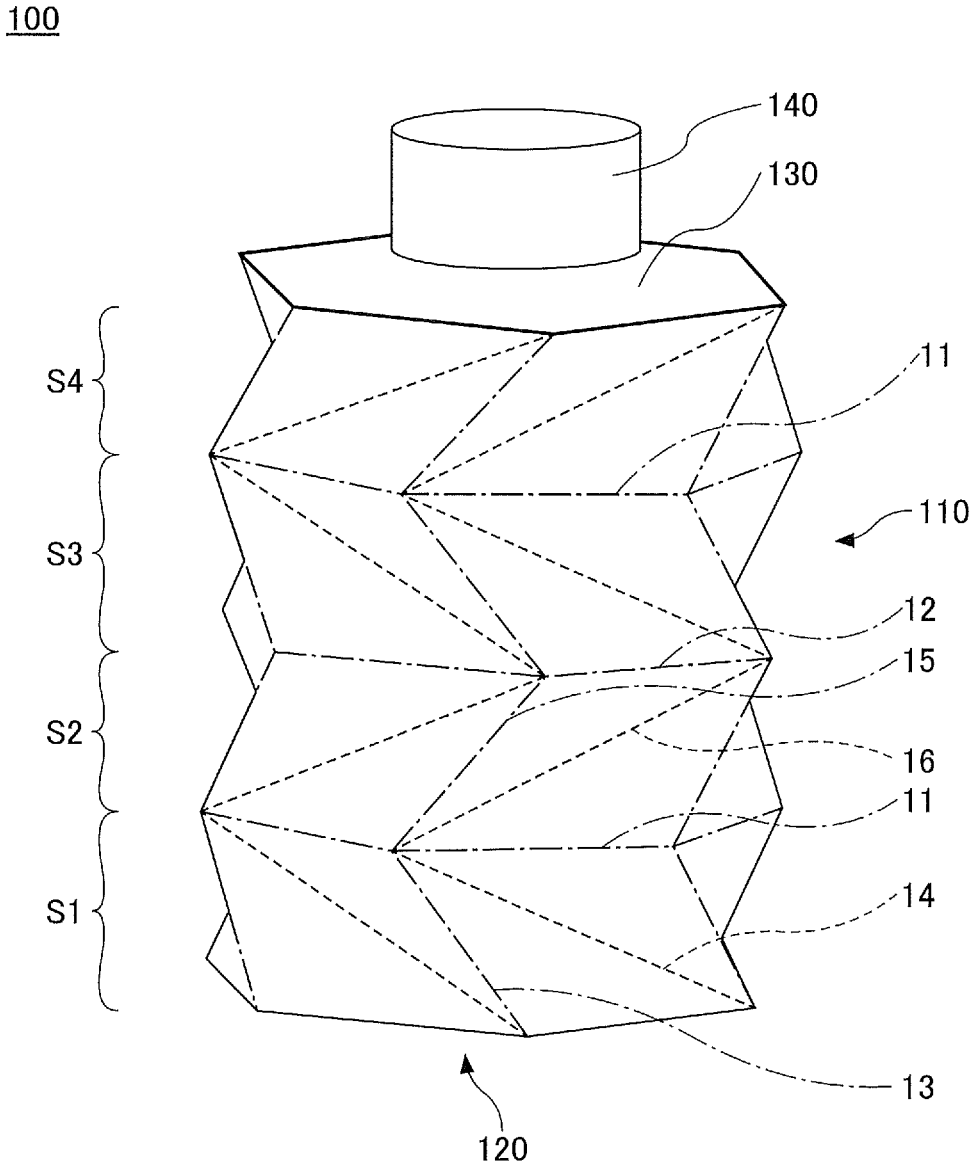
FIG. 1 is a drawing illustrating a container according to a first embodiment of the present invention.

FIG. 1 is a drawing illustrating a container 100 according to an embodiment of the present invention.

The container 100 of the present embodiment is formed as a monolithic structure including a side wall 110, a bottom wall 120, and an upper wall 130 including a mouth 140. Alternatively, the container of the present invention may be formed by separately forming a container body including a lower wall and a side wall and an upper wall part including a mouth, and then fitting them together (see FIG. 5 and FIG. 6).

Multiple units that can expand and shrink in a predetermined direction are formed in the side wall 110. In the example of FIG. 1, four units (tiers) S1, S2, S3, and S4 are formed. Also, in the side wall 110, the tiers are alternately inverted.

In the side wall 110, parallelograms are stacked in tiers such that each pair of the parallelograms in the upper and lower tiers have a common lower/upper side, and the parallelograms in the upper and lower tiers alternately become line-symmetrical (vertically symmetrical) with respect to the common lower/upper side. For example, in the example of FIG. 1, the units (tiers) S1 and S3 are parallelograms that rise to the left, and the units (tiers) S2 and S4 are parallelograms that rise to the right. With this configuration, the units S1 and S2 adjacent to each other in the vertical direction are vertically symmetrical, the units S2 and S3 are vertically symmetrical, and the units S3 and S4 are vertically symmetrical.

In the example of FIG. 1, the side wall 110 is formed by stacking four units S1, S2, S3, and S4 in the vertical direction. However, the number of units is not limited to four, and the side wall may be formed by stacking two, three, or five or more units as long as vertically adjacent units are vertically symmetrical.

Also, in the example of FIG. 1, the lowermost tier is the unit S1 composed of parallelograms rising to the left. However, the lowermost tier may be composed of parallelograms rising to the right. Similarly, although the uppermost tier is the unit S4 composed of parallelograms rising to the right in the above example, whether the uppermost tier is composed of parallelograms rising to the left or rising to the right is determined depending on the number of units so that the units adjacent to each other in the vertical direction become vertically symmetrical.

Also, folds 11 and 12 each of which is a symmetrical axis and formed of a common lower/upper side, the lower side of a parallelogram forming a part of the lower end of the side wall 110, and the upper side of a parallelogram forming a part of the upper end of the side wall 110 are mountain fold lines (ridge lines).

Each of the units S1 and S3 of the side wall 110 includes mountain fold lines formed of lateral sides 13 of the parallelograms and valley fold lines formed of diagonal lines 14 of the parallelograms. Each of the units S2 and S4 includes mountain fold lines formed of lateral sides 15 of the parallelograms and valley fold lines formed of diagonal lines 16 of the parallelograms. Each of the diagonal lines 14 of the units S1 and S3 and the diagonal lines 16 of the units S2 and S4 equally divides acute angles of the parallelogram.

In each of the units S1, S2, S3, S4 of the side wall 110, the lateral sides of the parallelograms are connected to each other to form a continuous structure that has a polygonal shape in a top view. That is, the container 100 is a hollow structure having a substantially polygonal cross section. In FIG. 1, as an example of the polygonal shape, each tier includes six parallelograms and has a hexagonal shape in a cross-sectional view. However, the number of sides of the polygonal shape is not limited to any specific value. As the number of sides of the polygonal shape increases, the cross-sectional shape becomes closer to a circle and the volume increases, but the height of the shrunk container increases due to the stacking of the sides. Accordingly, the number of sides is preferably determined depending on the application.

The bottom wall 120 of the container 100 has a polygonal shape corresponding to the number and positions of the lower sides of the lowermost tier (S1). For example, the bottom wall has a hexagonal shape. A shoulder part 22/22C of a mouth-side part 2 (see FIG. 5 and FIG. 6) has a polygonal shape in a top view corresponding to the number of upper sides of the uppermost tier (S4). In the example of FIG. 1, the outer edge of the upper wall has a hexagonal shape. That is, the outer edges of the upper wall 130 and the bottom wall 120 have the same polygonal shape or similar polygonal shapes.

The shape of the side wall 110 is called a reversed spiral cylindrical model (RSC) origami structure (see, for example, Non-Patent Document 1 and Non-Patent Document 2).

With this shape, the side wall 110 of the container 100 includes the mountain fold lines 11, 13, and 15 that are folds protruding outward and the valley fold lines 12, 14, and 16 that are folds protruding inward, and is expandable and shrinkable in a predetermined direction (the vertical direction in FIG. 1).

In the example of FIG. 1, the polygonal bottom wall 120, the side wall 110, and the upper wall 130 with a polygonal outer edge are connected to each other and formed as a monolithic structure. In the example of FIG. 1, the upper wall 130 has a flat shape. However, the upper wall 130 may be formed to rise toward the mouth.

The diameter or size of the mouth 140 protruding from the upper wall 130 illustrated in FIG. 1 is an example, and the size of the mouth 140 may be wider or narrower than that illustrated in FIG. 1.

The bottom wall 120, the side wall 110, and the upper wall constituting the container 100 may be formed of any material such as plastic, metal, a pouch, or paper (paper pack).

Also, the content to be contained in the container 100 may be any type of liquid or fluid such as a beverage, food, cosmetics, or paint.

Although not illustrated in FIG. 1, a removable cap may be attached to the mouth 140 to seal the container in a state where the content is partially used. This makes it possible to use the content in the container little by little.

Shrinking of Container

Figure 2:
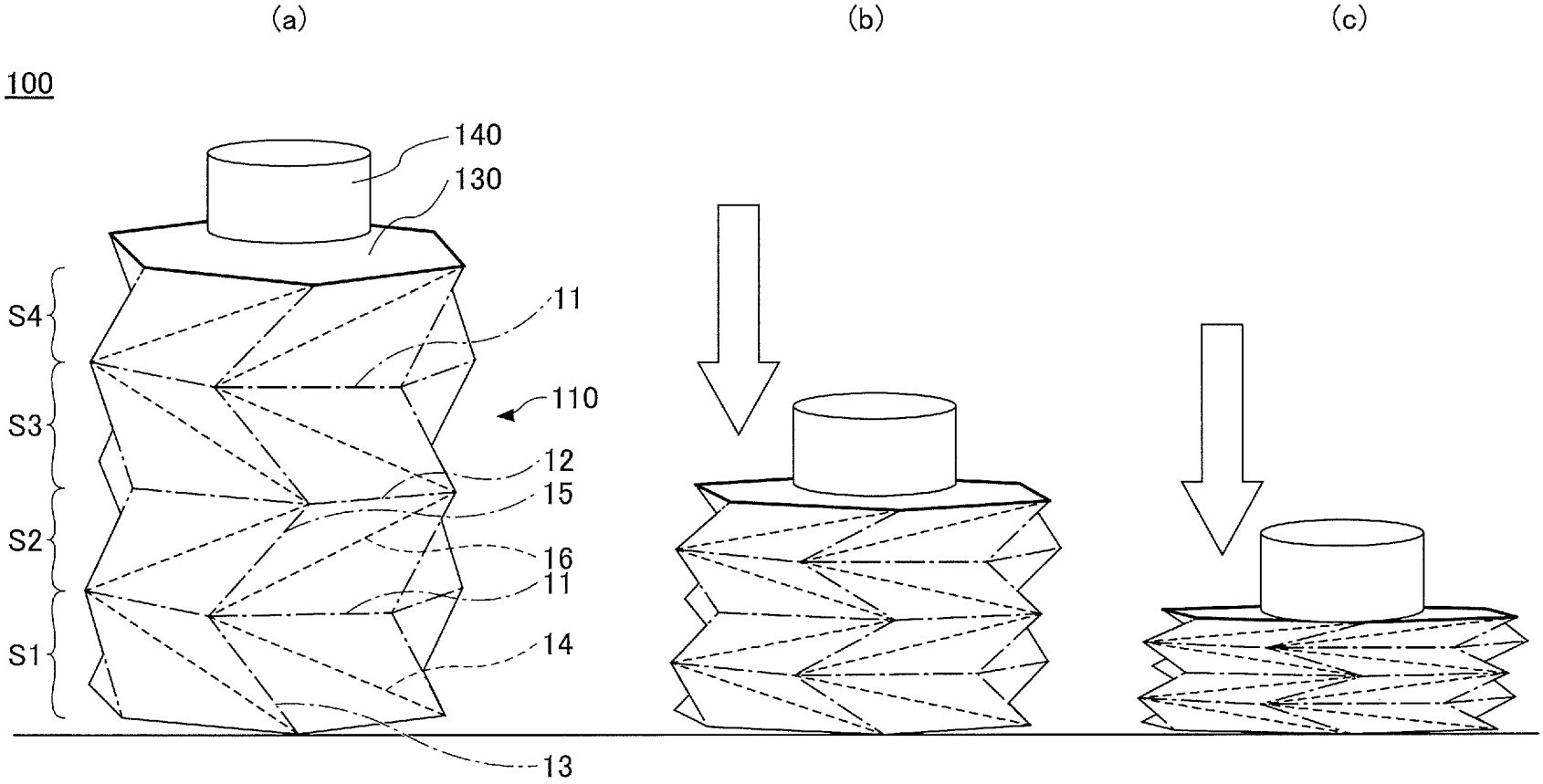
FIG. 2 is a drawing illustrating shrinking of the container of FIG. 1.

FIG. 2 is a drawing illustrating expansion and shrinking of the container 100 of FIG. 1. In FIG. 2, (a) illustrates an unused container, (b) illustrates a state of the container where the amount of the content has decreased, and (c) illustrates a state of the container after the entire content is used.

When the container 100 of the present invention is folded using fold lines like origami as illustrated in FIG. 2, unlike the case where a bellows shape is contracted, the restoring force causing the container to return to the state before being folded is less likely to be generated. Therefore, the side wall 110 of the container 100 can be folded without rebounding, and the volume can be reduced.

Also, as illustrated in FIGS. 2 (*a*) through 2 (*c*), in the container of the present invention, each vertically-adjacent pair of the units S1, S2, S3, and S4 are line-symmetrical in the vertical direction. Therefore, when the container is shrunk, the side wall 110 is folded vertically symmetrically, the upper end and the lower end of the side wall 110 do not rotate, and the upper end of the side wall 110 moves straight downward.

When the container 100 is shrunk in this manner, the center position (central axis) of the container 100 does not change in the horizontal direction, and the side wall of the container 100 collapses such that the horizontal outline is maintained. That is, the container is crushable in the vertical direction such that the projected shape of the upper part is maintained, and this may be referred to as a vertically-crushable shape.

Figure 3:
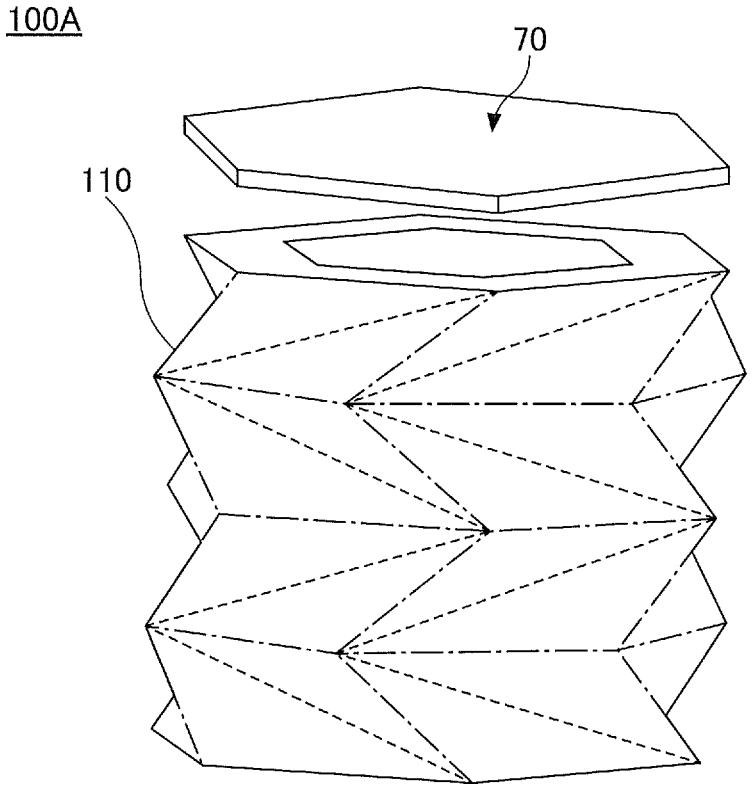
FIG. 3 is an overall view of a container according to a second embodiment of the present invention.

Also, for example, when the container 100 of FIG. 1 is a PET bottle formed of a resin or when the upper wall of a container 100A is not sealed as illustrated in FIG. 3 described later, the user can easily crush the container 100 after use with one hand by simply pressing the mouth 140 or the upper wall 130 of the container 100 or the upper end of the side wall 110 of the container 100A downward. Alternatively, when the container 100 (100A) is small, the user can easily crush the container 100 (100A) with one hand by simply pinching and pressing the upper end and the lower end of the container 100 (100A) with two fingers after use.

Also, because the container is crushed such that its outline is maintained, when the container of the present invention is, for example, a PET bottle or a beverage can and multiple empty containers containing no content are stacked in the vertical direction for collection, the containers do not slide sideways and are crushed by their own weight. This makes it possible to reduce the collection space and save the trouble of crushing the containers.

Also, when the container 100 is crushed, because force is less likely to be applied to parts other than predefined fold lines, scratches, dents, and cracks are less likely to be formed on the side wall 110. Accordingly, multiple containers 100 crushed along the fold lines have a similar appearance and look good. Because multiple containers 100 can be crushed to have a similar appearance, the recycling process of collecting and reusing the containers 100 can be easily performed by simply spreading the folds after cleaning.

In the above example, the container of the present invention has a configuration including a mouth to which a removable cap is attachable based on an assumption that the content in the container is used little by little. However, the container of the present invention may be used as a single-use container the entire content of which is used at once.

Further, when the container of the present invention is used as a single-use container, the upper wall 130 including the mouth 140 may be omitted.

Open Container

FIG. 3 is an overall view of a container 100A according to a second embodiment of the present invention. With this configuration, a cap 70 for covering the upper end of the side wall 110 to be sealed is attached to the container 100A until immediately before use, and the cap 70 is removed when the container 100A is used.

The cap 70 is, for example, a cap seal such as an aluminum foil on the back surface of which a sealing treatment is performed. Alternatively, the cap 70 may be a metal multi-cap that is opened by using, as a lever, a metal or resin ring tab into which a finger of the user can be inserted, a cap that is opened by unwinding and removing a tab seal provided below the cap, or a metal or resin screw cap having a female screw that can be screwed over a male screw having substantially the same diameter and formed near the upper end of the side wall.

Attaching Discharge Mechanism

Figure 4:
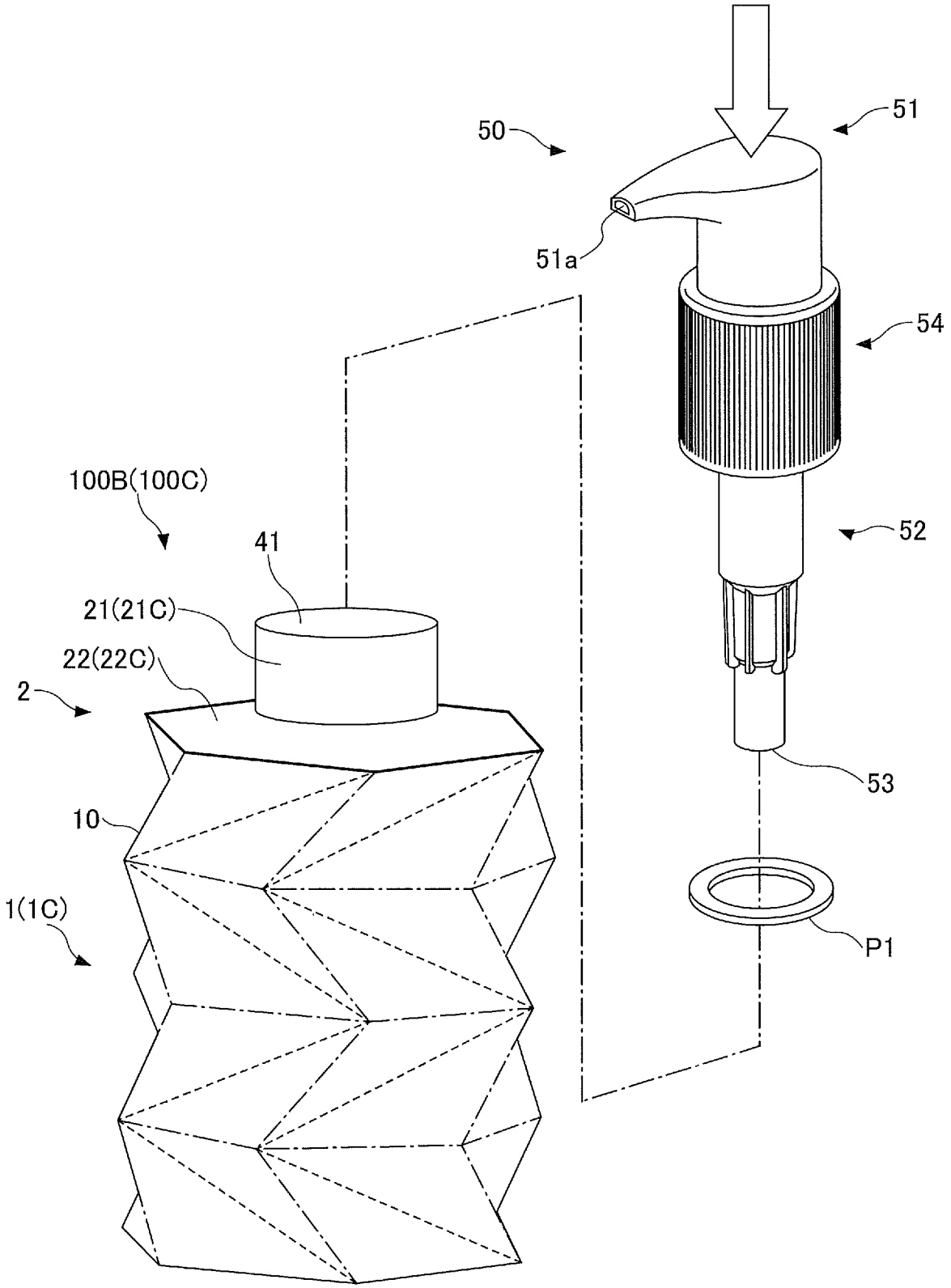
FIG. 4 is a drawing illustrating an example where a discharge mechanism is attached to a mouth of a container of the present invention.

FIG. 4 illustrates an example in which an airless discharge mechanism 50 is attached to a mouth 21 of a container 100B of the present invention. The discharge mechanism 50 illustrated in FIG. 4 is an example of a discharge mechanism (airless pump) of a side discharge type.

The airless discharge mechanism discharges a liquid (fluid) content by applying pressure to the content itself without using air. The airless discharge mechanism of the present invention includes a mechanism that prevents the inflow of air into the container 100B when the content is discharged.

The discharge mechanism 50 illustrated in FIG. 4 includes a neck part 51 including a discharge opening 51*a*, a body 52 connected to the neck part 51, a cylindrical intake tube 53 connected to the lower end of the body 52, and a cap 54 that is provided around the joint between the body 52 and the neck part 51.

When the airless discharge mechanism 50 is attached to the container 100B, the container 100B is used to contain a content that is liable to change on exposure to air and requires airtightness (gas barrier property, air barrier property, and/or moisture barrier property). Therefore, the mouth 21 of the container 100B before use is sealed and closed with a closing film 41 (see FIG. 5). When the discharge mechanism 50 is attached to the mouth 21, the intake tube 53 is stuck into the closing film 41 to break the closing film 41 closing the mouth 21. Then, the cap 54 is fitted to the mouth 21 by screwing or packing (fixing).

Here, the intake tube 53 of the discharge mechanism 50 is not in contact with the content in the stored state. When the neck part 51 is pressed, the inside of a container body 1 is suctioned, the side wall shrinks as the pressure in the container body 1 decreases, and the volume of the container body 1 decreases. As a result, the content moves into the discharge mechanism 50, and a predetermined amount of the content is discharged to the outside.

Also, to keep the airtightness, the discharge mechanism 50 includes an annular packing P1, a suction valve for opening and closing, and a discharge valve (not shown).

With this configuration where the discharge mechanism 50 is attached to the mouth 21, almost no air flows into the discharge mechanism 50 even after the closing film 41 is broken. This makes it possible to minimize the exposure of the content in the container body 1 to oxygen and thereby makes it possible to suppress the denaturation of the content due to oxidation until the content is discharged.

Thus, with the configuration where the cap 54 of the discharge mechanism 50, which prevents air from flowing into the container body 1 during use, is attached to the mouth 21 (or a sealing cap 40 (see FIG. 7) is attached to the mouth 21 including a check valve), the container body 1 can automatically shrink downward as illustrated by FIG. 2 (*a*)=>(b)=>(c) due to the air pressure, i.e., the difference between the pressures inside and outside of the container body 1, as the amount of the content in the container body 1 decreases, and can maintain the shrunk state.

Examples of Material Configurations

In the case of the configuration where the discharge mechanism 50 is attached as described above, the container is preferably formed of a material that can block air. For example, the container preferably includes a metal layer or an inorganic layer. The metal layer preferably includes aluminum, iron, gold, silver, titanium, tin, zinc, platinum, ruthenium, palladium, iridium, an alloy (tin plate), or a metal oxide (e.g., aluminum oxide (alumina)). "Including a metal layer" may indicate that the container is entirely formed of a metal material or that the container includes a metal film that is formed by depositing a metal on a surface or an inner surface of another material (for example, a resin). The inorganic layer may indicate a layer including an inorganic substance such as silica gel (silicon oxide).

The metal layer and the inorganic layer are air shielding materials. The metal layer is also a light shielding material. The inorganic layer may be colored to have a light shielding property, or may be made transparent to have no light shielding property.

Here, when the container includes a metal layer or an inorganic layer, it is difficult to form the container including the bottom wall, the side wall, and the upper wall including the mouth as a monolithic structure as illustrated in FIG. 1.

Therefore, a container including a metal layer or an inorganic layer and used together with a discharge mechanism is preferably formed by separately forming a container body including a lower wall and a side wall and an upper wall part including a mouth and then fitting the container body and the upper wall part together. Hereafter, a component including a bottom wall and a side wall is referred to as a container body.

Also, the bottom wall 17 of the container body 1 and parts of the side wall 10 other than the fold lines and the valley lines may include, for example, a plastic such as polyethylene (PE), polypropylene (PP), or polyethylene terephthalate (PET) for reinforcement so that these components can maintain an upright state even when the container is shrunk.

Parts of the side wall 10 corresponding to the mountain fold lines and the valley fold lines are preferably formed without using the above-described plastic material or by making the plastic material thinner than the other parts. With this configuration, the parts corresponding to the fold lines and the valley lines do not become thick when the side wall is folded, the side wall can be folded and shrunk to have a smaller thickness, and the amount of the content remaining in the container body 1 can be reduced.

The container body 1 is suitable to contain a content including a substance that is liable to be changed by oxygen and/or light. Examples of contents include, but are not limited to, cosmetics containing vitamins (vitamin A, vitamin C, etc.) and their derivatives, and pharmaceuticals and foods that are liable to be deteriorated by oxidation.

Also, with the configuration of the container to which the discharge mechanism is attached, the container body 1 shrinks according to the amount of remaining content while maintaining the sealed state. This makes it possible to determine the amount of remaining content at a glance by checking the shrunk state of the container body 1 from the outside.

The container of the present embodiment may be used for a low-viscosity liquid that needs to be shielded from air and is used in multiple batches. Examples of containers for such a liquid include a seasoning container, a seasoning tube, a mini travel bottle for cosmetics or a hygiene product, a package for a retort food, and a beverage pouch.

Also, the content can be sprayed by adjusting the diameter of the discharge opening 51*a* of the discharge mechanism 50 illustrated in FIG. 4 and by selecting the type of the piston provided inside of the discharge mechanism 50.

Also, with this configuration, the discharge mechanism 50 and the container 100B may be sold separately and assembled by the user.

Because the content passes through the inside of the cap 54 only when the content is used, the discharge mechanism 50 may be formed of any material that can withstand the discharge operation and the operation of the check valve. The discharge mechanism 50 is more preferably formed of, for example, a plastic including a metal layer or an inorganic layer having an excellent air shielding property so that air does not enter the container body 1 through the discharge mechanism 50.

When the discharge mechanism 50 is to be attached to the mouth by the user, the container body 1 and the discharge mechanism 50 are filled with an inert gas at the time of shipment to make them oxygen-free. With this configuration, even when the closing film 41 is broken by the user with the intake tube 53 immediately before use, almost no air flows into the container body 1. Therefore, the exposure of the content in the container body 1D to air is minimized, and the denaturation of the content due to oxidation is suppressed until the content is discharged.

When the content in the container 100B with the discharge mechanism 50 decreases, the container 100B is folded such that the mountain fold lines 11, 13, and protrude outward and the valley fold lines 12, 14, and 16 protrude inward. Because air does not flow into the container 100B due to the check valve and the pressure in the container 100B becomes lower than the atmospheric pressure, the vertically-shrunk state of the container 100B is maintained.

The container body 1 is formed of a material including a metal layer and has a structure formed by vertically stacking protruding and recessed surfaces in tiers, and the same pattern appears in every other tier of the side wall 10 of the container body of the present invention. Therefore, the ridge line formed of the diagonal line of the parallelogram returns to the same vertical line (corresponding to the generatrix) every two tiers. Because the ridge lines form a continuous zigzag pattern on a vertical plane (a vertical line corresponding to the generatrix) in a projection plane of the container, it is possible to create a split mold and to simplify the manufacturing process.

Figure 5:
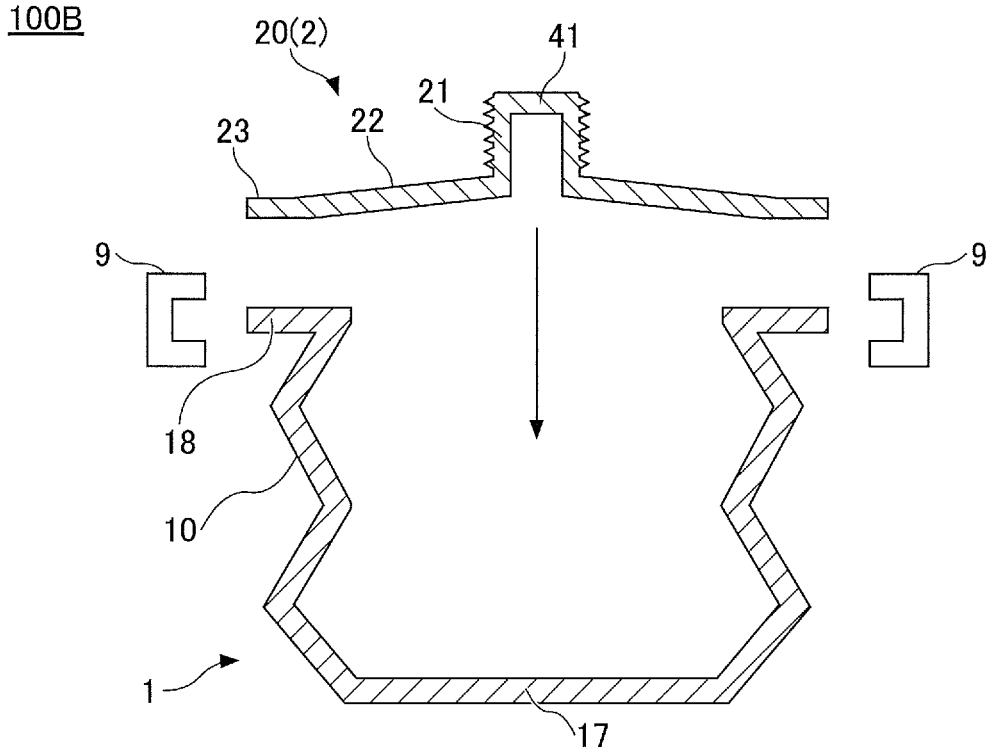
FIG. 5 is an exploded view illustrating a first fitting example where a container of the present invention includes a metal layer or an inorganic layer.
Figure 6:
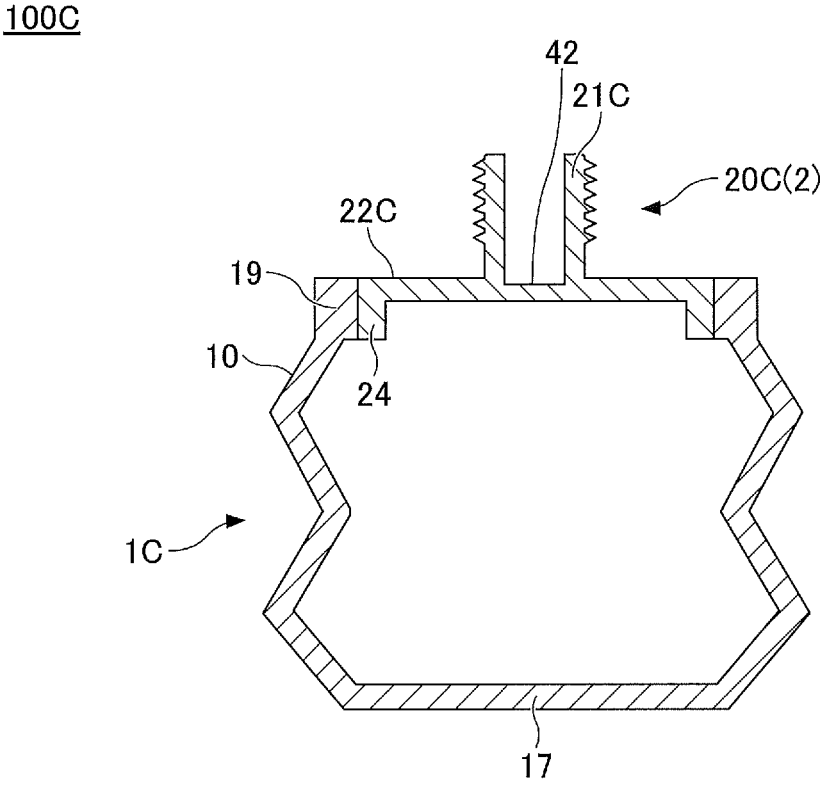
FIG. 6 is a drawing illustrating a second fitting example where a container of the present invention includes a metal layer or an inorganic layer.

When the container body of the present invention is formed of a metal layer or a layer on which an inorganic substance is deposited, it becomes difficult to form the upper wall, the side wall, and the bottom wall as a monolithic structure in terms of manufacturing processes such as injection molding and pressing. Therefore, as illustrated in FIG. 5 and FIG. 6, the upper wall may be formed separately from the container body including the side wall and the bottom wall.

When the container 100A including no upper wall as illustrated in FIG. 3 is used for a content that is liable to change due to oxygen or light, the container 100A is preferably used as a single-use container because the light shielding effect and the air shielding effect are lost. Here, it is assumed that the state (quality) of the content immediately after opening the container can be maintained for a short period of time (for example, about one hour) after the container is opened. Examples of single-use containers requiring an air shielding property and implemented by the container 100A illustrated in FIG. 3 include packages for fluids such as cosmetic samples, mini travel bottles for cosmetics and hygiene products, hair color bottles, single-use containers for seasonings, containers for foods such as jellies and puddings, retort food containers, and containers for sample beverages; and containers used for transportation of photosensitive electronic components.

Because this configuration does not include a lid (upper wall) for temporary storage, when a fluid is used as a content, the residue of the content adhering to the upper wall can also be reduced. Also, because a lid or an upper pressing part formed of a resin is not provided, it is possible to eliminate the need of waste sorting.

An example where the upper wall of the container is formed separately from and fitted to the container body including the side wall and the bottom wall is described below with reference to FIG. 5 and FIG. 6.

First Fitting Example of Upper Wall

In this example, a container 100B includes a container body 1 and a mouth-side part 2. The container body 1 is a container for containing a content and includes a side wall 10 and a bottom wall (lower wall) 17.

Also, the mouth-side part 2 (a lid 20, a lid 20C) provided above the container body 1 includes a mouth 21 and a shoulder part 22.

FIG. 5 is an exploded view illustrating a first fitting example where a container of the present invention includes a metal layer or an inorganic layer. In the present embodiment, the mouth-side part 2 is a lid 20.

As illustrated in FIG. 5, a flange 18 protruding outward in the horizontal direction is provided at the upper end of the side wall 10 of the container body 1. The flange 18 has a substantially polygonal ring shape or a ring shape having a polygonal inner circumference and a circular outer circumference.

Also, in the present embodiment, the lid 20 is attached to the upper surface of the flange 18. Similarly to the container body 1, the lid 20 includes a metal layer.

The lid 20 includes the mouth 21, the shoulder part 22 connected to the mouth 21, and a closing film 41 that closes the mouth 21. The mouth 21 rises upward from the shoulder part 22 as illustrated in FIG. 5. In the example of FIG. 5, the closing film 41 and the mouth 21 of the lid 20 including the metal layer are formed as a monolithic structure. However, the closing film 41 may be formed separately from the lid 20 and attached to the mouth 21.

In this configuration, the container body 1B includes a metal layer or an inorganic layer, and the lid of the upper wall and the closing film 41 closing the mouth 21 include metal layers. With this configuration, the content contained in the container 100C is surrounded by an air barrier layer in all directions, and the container 100B can keep the air shielding property until immediately before the discharge mechanism 50 is attached.

For example, the cap 54 of the discharge mechanism 50 (see FIG. 4) or a sealing cap 40 (see FIG. 7) is attached to the mouth 21.

An end part 23 of the shoulder part 22 of the lid 20 and the flange 18 are fixed together from the outside with a fastener (engaging screw) 9.

In the present embodiment, at the time of shipment, the container body 1 is filled with a content under an oxygen-free near-vacuum atmosphere or in a state where the container body 1 is filled with an inert gas, and then the lid 20 is attached to the flange 18 and fixed with the fastener 9.

Specifically, for example, when the content is liable to be oxidized, the container body is sealed in an oxygen-free state during the manufacturing process. Here, "oxygen-free" refers to a near-vacuum state or a state filled with an inert gas (e.g., nitrogen). For example, considering a manufacturing error, during the manufacturing process, the content is injected into the container body 1 under an inert gas such as nitrogen, and the container body 1 is sealed with the lid 20. As a result, the container body 1 is filled with the content and the inert gas.

Then, the closing film 41 is broken immediately before use. Because the manufactured container body is sealed as described above, the inside of the container 100B is oxygen-free (in a near-vacuum state or a state filled with an inert gas) in the distribution stage before use, and the oxidation or deterioration of the content can be prevented.

Second Fitting Example of Upper Wall

FIG. 6 is a drawing illustrating a second fitting example where a container of the present invention includes a metal layer or an inorganic layer.

The present embodiment is different from the fitting example of FIG. 5 in that, in a container 100C, a lid 20C forming the upper wall is configured to fit into the inside of the upper end of the side wall 10 of a container body 10. Also, in the present embodiment, no flange protruding outward is provided at the upper end of the side wall 10, and an upper end part 19 of the side wall 10 rises upward.

In the present embodiment, the peripheral part (peripheral wall) of the lid 20C is bent downward, and the lid 20C is attached such that the outer side surface of the peripheral part (peripheral wall) closely contact the inner side surface of the upper end part 19 of the side wall.

Also, a closing film 42 is provided to close a mouth 21C of the lid 20C before use. The closing film 42 in a part corresponding to the mouth 21C is configured to be breakable when a certain pressure is applied in a concentrated manner by, for example, the intake tube 53 of FIG. 4.

In FIG. 6, the closing film 42 and a shoulder part 22C of the lid 20C including the metal layer are formed as a monolithic structure, and the closing film 42 has a thickness that is the same as or less than the thickness of the shoulder part 22C. Also in this configuration, the closing film 42 may be formed separately from the lid 20C and attached to the mouth 21C.

In the example of FIG. 6, the closing film 42 is configured to close the lower end of the mouth 21C. However, similarly to FIG. 5, the closing film 42 may be configured to close the upper end of the mouth 21C.

Also in the present embodiment, at the time of shipment, the content is poured into the container body under an oxygen-free atmosphere, and then the lid 20C is attached.

Also in this configuration, the container body includes a metal layer or an inorganic layer, and the lid 20C and the closing film 42 covering the mouth 21C include metal layers. Accordingly, the content contained in the container 100C is surrounded by a metal in all directions, and the air shielding property of the container 100C can be achieved.

When used, the closing film 42 in the bottom of the mouth 21C is broken. Alternatively, when the sealing cap 40 described later or the discharge mechanism 50, which can prevent the inflow of air, is attached to the mouth 21C, a part of the closing film 42 may be broken and removed. Also in the present embodiment, because the manufactured container body is sealed as described above, the inside of the container 100C is oxygen-free in the distribution stage before use, and the oxidation or deterioration of the content can be prevented.

Although the shoulder part 22 of the lid 20 in FIG. 5 has a shape that rises toward the center, the lid may have a flat shape like the shoulder part 22C of the lid 20C in FIG. 6. On the contrary, although the shoulder part 22C of the lid 20C in FIG. 6 has a flat shape, the shoulder part 22C may have a shape that rises toward the center like the shoulder part 22 of the lid 20 in FIG. 5.

Each of the containers 100B and 100C illustrated in FIG. 5 and FIG. 6, which includes metal layers or inorganic layers and to which the discharge mechanism 50 is attached, can be shrunk such that its volume decreases according to the amount of remaining content as illustrated in FIG. 2. With this configuration, the container 100B and 100C of the present invention can continuously protect the content from air and maintain the quality of the content to the end.

Attaching Sealing Cap

Figure 7:
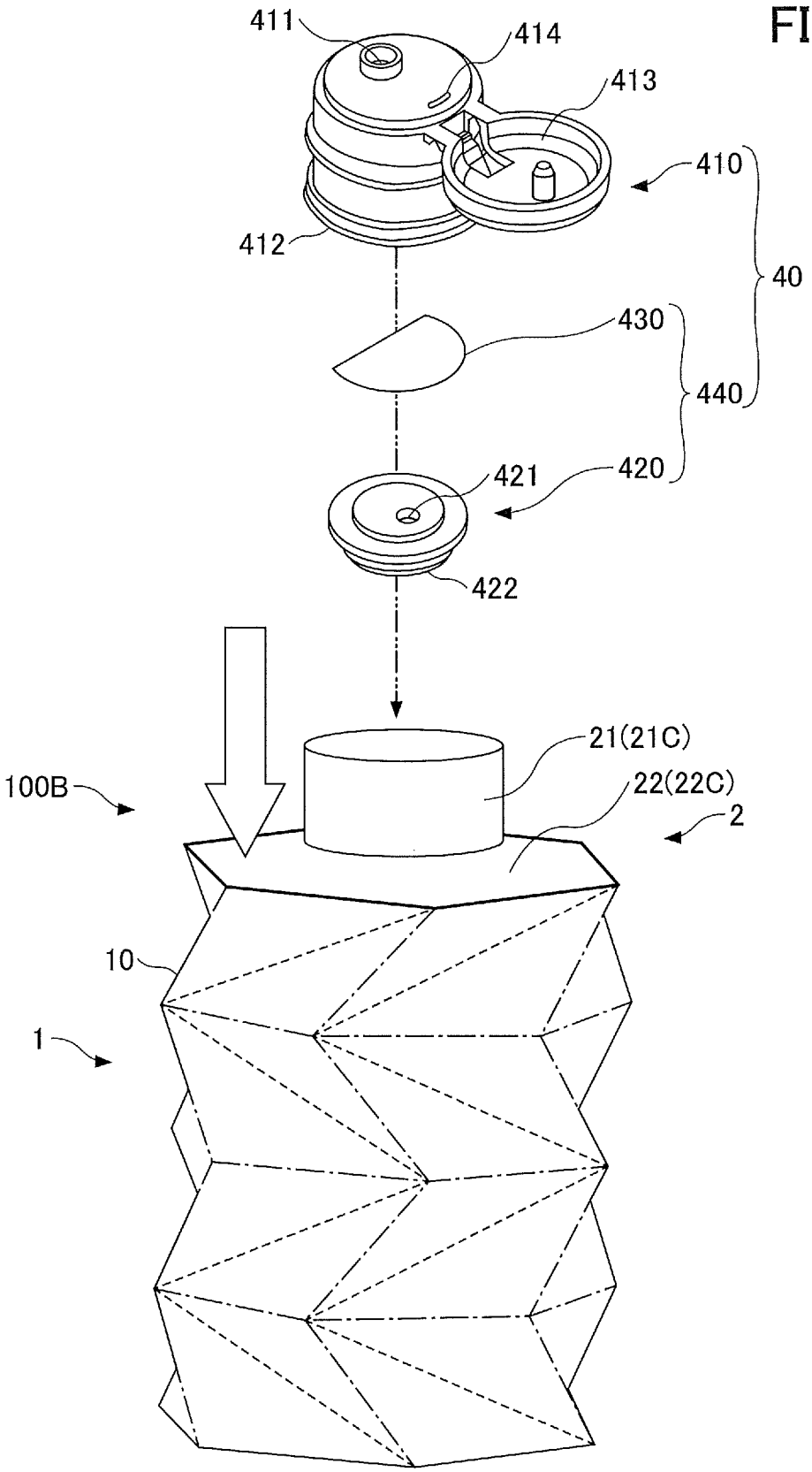
FIG. 7 is a drawing illustrating an example where a sealing cap is attached to the mouth of a container of the present invention.

FIG. 7 illustrates an example where a sealing cap is attached to the mouth of the container 100B (100C) of the present invention. The sealing cap 40 attached to the container 100B in FIG. 7 is an example of a commonly known sealing cap with a check valve. The sealing cap 40 includes a cap body 410, a base 420, and a film 430.

The base 420 attached to the upper edge of the mouth 21 includes a valve hole 421 and is press-fitted into the cap body 410. The film 430 placed on the upper surface of the base 420 to cover the valve hole 421 and the base 420 are attached to the upper edge of the mouth 21 and function as an intake valve 440 (intake disc film, or check valve) in which the valve hole 421 serves as an entrance, the film 430 serves as a disc, and the upper surface of the base 420 serves as a seat. The intake valve 440 allows the content to be discharged while preventing outside air from entering the container body 1.

The cap body 410 is a cylindrical body with a top, and includes a spout 411 for discharging the content at the top and a stopper 412 for fixing the container body 1 and the intake valve 440 at the lower end of the cylindrical body. Also, a lid 413 including a hinge 414 for opening and closing the spout 411 is formed at the top of the cap body 410.

In this configuration, for example, the sealing cap 40 is attached to the container 100B before shipment. For example, when the user rotates or pushes down the sealing cap 40 immediately before use, the closing film 41 is broken by a protrusion (not shown) provided on the lower side of the sealing cap 40. Even on this occasion, because the check valve is provided, almost no air flows into the container body 1, the exposure of the content in the container body 1 to air is minimized, and the denaturation of the content due to oxidation is suppressed until the content is discharged.

The cap body 410 is not limited to a circular cylindrical body. The shape of the cap body 410 may be determined based on the shape of the mouth 21 or design and may be, for example, a rectangular cylinder.

As in the case where the discharge mechanism 50 is attached, the container illustrated in FIG. 7 to which the sealing cap 40 is attached is preferably one of the containers 100B and 100C illustrated in FIG. 5 and FIG. 6 that include metal layers or inorganic layers.

Because the content passes through the inside of the cap only when the content is used, the sealing cap may be formed of any material that can withstand opening and closing of the cap. The sealing cap 40 is more preferably formed of, for example, a plastic including a metal layer or an inorganic layer having an excellent air shielding property so that air does not enter the container body 1 through the sealing cap 40.

In this configuration, when a content has a low viscosity, the content can be discharged by tilting the container 100B such that the sealing cap 40 faces obliquely downward and by applying a force such that the shoulder part 22 and the bottom wall 17 come close to each other. In this case, the side wall 10 of the container 100B shrinks along the tilted direction (predetermined direction) instead of along the vertical direction.

Alternatively, in this configuration, when a content has a high viscosity, the content can be discharged by pressing the shoulder part 22 downward while the container 100B is in the upright position as illustrated in FIG. 5. This configuration is suitable for a case where the content discharged upward is used by wiping off the content with, for example, a finger, a sponge, a puff, cotton, a tissue, or kitchen paper.

Each of the containers 100B and 100C, which includes metal layers or inorganic layers and to which the sealing cap 40 is attached, can be shrunk such that its volume decreases according to the amount of remaining content as illustrated in FIG. 2. With this configuration, the container 100B and 100C of the present invention can continuously protect the content from air and maintain the quality of the content to the end.

Also, with this configuration, the container body 1 (10) shrinks in response to a load from the user while maintaining the sealed state and the negative pressure state, and as a result, the shrunk state of the container body 1 is maintained. This makes it possible to determine the amount of remaining content at a glance by checking the shrunk state of the container body 1 (10) from the outside.

The container 100B (100C) of this configuration is used for a container requiring an air shielding property and containing a liquid that has a low or high viscosity and is used in multiple batches. For example, the container 100B (100C) is suitable for a seasoning container, a mini travel bottle for cosmetics or a hygiene product, and a fluid package such as a beverage pouch.

<Double-Wall Container>

Figure 8:
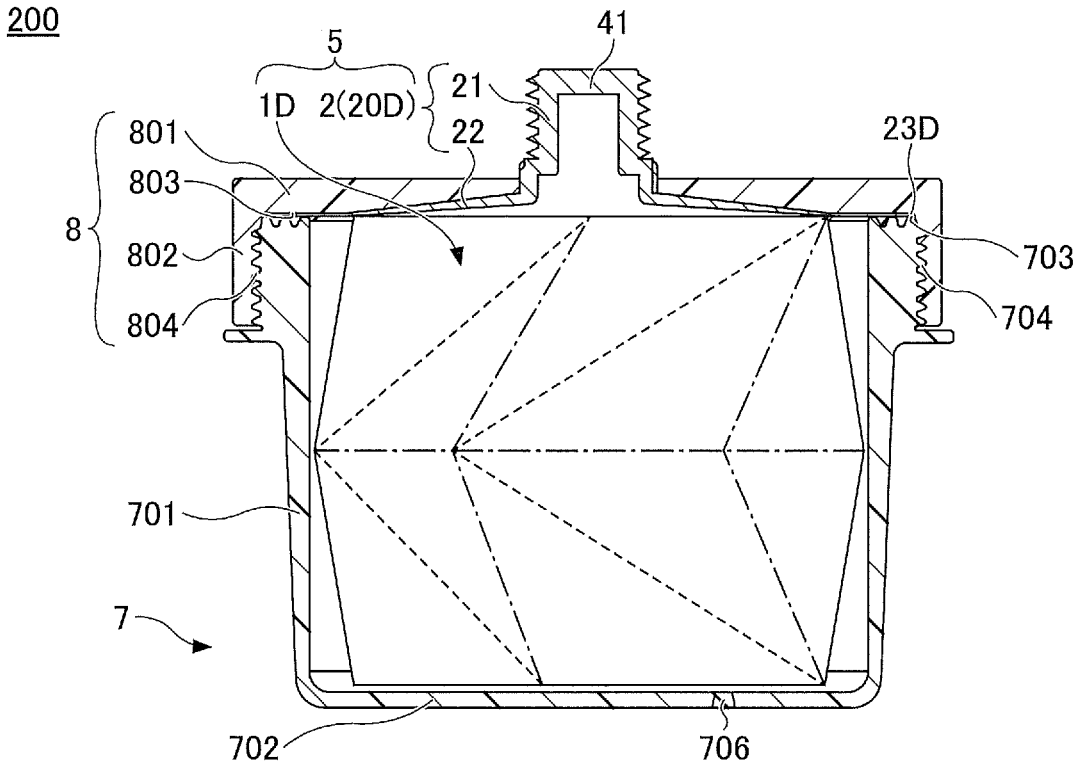
FIG. 8 is a drawing illustrating a first configuration example of a double-wall container including a container of the present invention as an inner container.

FIG. 8 illustrates an example of a double-wall container including a container of an embodiment of the present invention as an inner container. In this configuration, a container having a side wall as illustrated in FIG. 1 is used as an inner container (inside container) 5 housed in an outer container (outside container). The combination of the inner container 5 and an outer container 7 functions as a double-wall container 200.

In the double-wall container 200, a container body 1D is formed of a flexible material that can shrink in response to decompression, and the outer container 7 is formed of a strong material that has a shape retaining property and can provide protection against an external impact. A lid 20D is to be fitted to the container body and is therefore formed of a material that has a shape retaining property to such an extent that the lid 20D can retain its shape.

In the example of FIG. 8, the double-wall container 200 includes the inner container 5, a mouth-side part 2, the outer container 7, and an upper fixing part 8. Similarly to the lid 20 of FIG. 5, the lid 20D, which is the mouth-side part 2, includes a mouth 21 and a shoulder part 22. The lid 20D is different from the lid of FIG. 5 in that an end part 23D is thinner than the lid 20 of FIG. 5. The inner container 5 is composed of the container body 1D and the lid 20D.

The outer container 7 has a bottle-like shape including a side wall 701 and a lower wall 702 and houses the inner container 5. Also, fitting protrusions 703 are formed at the upper end of the side wall 701 of the outer container 7. Further, fitting protrusions 704 are formed on the outer surface of the side wall 701 near the upper end.

The upper fixing part 8 includes a top plate 801 that covers the shoulder part 22 of the mouth-side part 2 (the lid 20) other than the mouth 21 from above, and a lid peripheral wall 802 that extends downward from the periphery of the top plate 801. Fitting grooves 803 are formed near the peripheral edge of the top plate 801, and fitting grooves 804 are formed on the inner circumferential surface of the lid peripheral wall 802. The upper fixing part 8 and the outer container 7 are formed of a strong material(s) that has a shape retaining property and can provide protection against an external impact.

The double-wall container 200 is assembled by fitting together the fitting protrusions 703 and 704 on the upper end and the outer surface of the side wall 701 of the outer container 7 and the fitting grooves 803 and 804 on the top plate 801 and the lid peripheral wall 802 of the upper fixing part 8.

This double-wall container is configured as a so-called airless container. For example, the inner container (inner bag) may be formed of a flexible material and detachably attached to the outer container, and a liquid may be contained in the inner container. The double-wall container may be configured such that the liquid is suctioned through an intake opening by the pumping action of the discharge mechanism 50 while deforming and reducing the volume of the inner bag, and air is supplied into a space between the inner container and the outer container through an air intake hole formed in the outer container.

For example, in the present embodiment, a metal layer is formed by depositing a metal such as aluminum on a plastic sheet to give flexibility to a container used as the inner container while also giving an air shielding property and a light shielding property to the container. The metal to be deposited is not limited to aluminum, and iron, gold, silver, titanium, tin, zinc, platinum, ruthenium, palladium, iridium, an alloy (tin plate), or a metal oxide (e.g., aluminum oxide (alumina)) is also preferably used.

Also, in the present invention, the container used as an inner container may include an inorganic layer that is formed by, for example, depositing an inorganic substance on a plastic sheet to provide flexibility. The inorganic substance is, for example, silica gel (silicon oxide).

In the double-wall container, the inner container 5 is surrounded by the outer container 7. Therefore, the container body 1D does not need to include a reinforcing structure made of, for example, a plastic to maintain the upright position even when the container body 1D shrinks as illustrated in FIGS. 2 (*a*) through 2 (*c*).

The outer container 7 includes a plastic or a resin such as polyethylene (PE), polypropylene (PP), or polyethylene terephthalate (PET) to withstand an external impact. Also, the entirety or a part of the outer container 7 may be made transparent so that the shrinking of the inner container 5 is visible from the outside. When a part of the outer container 7 is made transparent, it is preferable to form a slit extending in the vertical direction so that the shrinking of the inner container 5 is visible from the outside.

Also with this configuration, because the container body 1D includes a metal layer or an inorganic layer and the lid 20D and the closing film 41 closing the mouth 21 include metal layers, the double-wall container 200 can achieve the air shielding property.

Also, a light shielding property may be given by forming the container body 1D with a metal layer, or by forming the container body 1D with a transparent inorganic layer and forming the outer container 7 with a material including an opaque resin.

Figure 9:
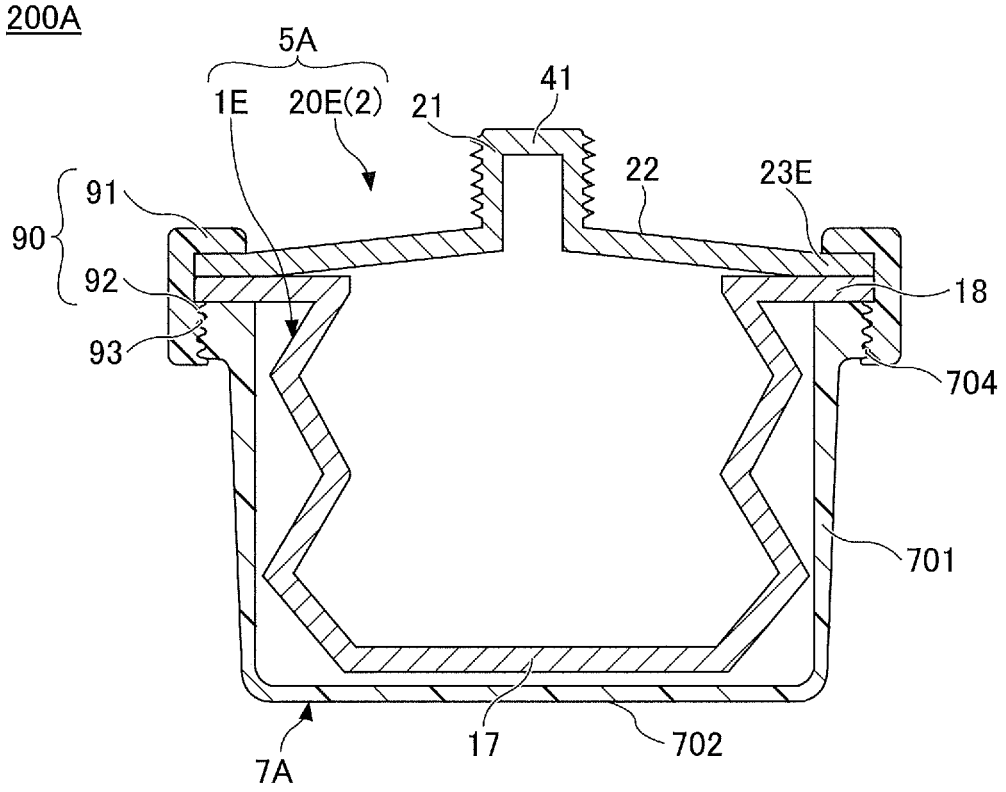
FIG. 9 is a drawing illustrating a second configuration example of a double-wall container of the present invention.
Figure 10:
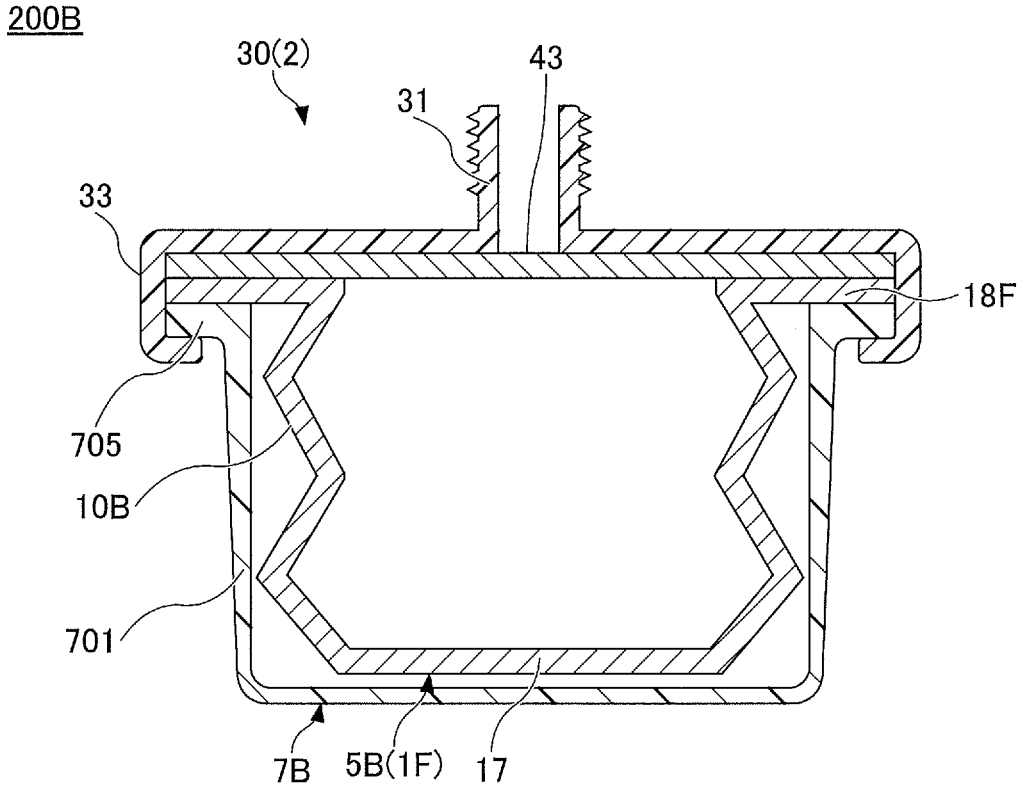
FIG. 10 is a drawing illustrating a third configuration example of a double-wall container of the present invention.

The configuration of the double-wall container is not limited to the example of FIG. 8, and the double-wall container may have a configuration as illustrated in FIG. 9 or FIG. 10.

Double-Wall Container (Second Configuration Example)

FIG. 9 is a drawing illustrating a second configuration example of a double-wall container of the present invention. The configuration of FIG. 9 differs from the configuration of FIG. 8 in that a fastener 90 is smaller than the upper fixing part 8. Also, a lid 20E has the same configuration as the lid 20 of FIG. 5.

In this configuration, an inner container 5A includes a container body 1E and the lid 20E. A flange 18 protruding outward in the horizontal direction is provided at the upper end of the side wall 10 of the container body 1E. The flange 18 has a substantially circular ring shape or a ring shape having a polygonal inner circumference and a circular outer circumference. Also, the lid 20 is attached to the upper surface of the flange 18. The outer container 7 includes a side wall and a lower wall, and also includes the fastener 90.

The fastener 90 is a ring-shaped sealing part including an upper wall 91 and a side wall 92. Fitting grooves 93 are formed on the inner circumferential surface of the side wall 92.

The flange 18 and an end part 23E of the shoulder part 22 of the lid 20E are sandwiched between the top surface of the side wall 701 of the outer container 7 and the fastener 90. That is, similarly to the upper fixing part 8 of FIG. 8, the double-wall container is assembled by sandwiching the end part 23E of the shoulder part 22 of the lid 20 and the flange 18 of the inner container 5A with the fastener 90 such that the fitting grooves 93 of the fastener 90 and the fitting protrusions 704 of the outer container 7 are fitted together.

Similarly to FIG. 5, the lid 20E includes the shoulder part 22 and the mouth 21 protruding upward from the shoulder part 22. The closing film 41 is provided in the mouth 21, and the closing film 41 is broken when used.

Also in this configuration, because the container body 15 includes a metal layer or an inorganic layer and the lid 20E and the closing film 41 covering the mouth 21 include metal layers, the double-wall container 200A can achieve the air shielding property.

Double-Wall Container (Third Configuration Example)

FIG. 10 is a drawing illustrating a third configuration example of a double-wall container of the present invention. In the present embodiment, the mouth-side part 2 is implemented by an upper pressing part 30. In this configuration, an inner container 5B is implemented by a container body 1F.

A double-wall container 200B of this configuration also includes a metal film 43 and the upper pressing part 30. The upper pressing part 30 includes a mouth 31, a shoulder part 32 connected to the mouth 31, and a peripheral wall 33 extending downward from the outer edge of the shoulder part 32.

A flange 18F protruding outward in the horizontal direction is provided at the upper end of a side wall 10F of the container body 1F of the inner container 5B. The flange 18F has a substantially circular ring shape or a ring shape having a polygonal inner circumference and a circular outer circumference.

In this configuration, the outer container 7B also includes a substantially annular flange 705 formed at the upper end of the side wall of the container body to protrude outward in the horizontal direction.

The metal film 43 is attached to the lower surface of the upper pressing part 30. At the time of shipment, after the content is poured under an oxygen-free atmosphere, the inner container 5B is sealed by fitting the upper pressing part 30 and the inner container 5B together. Alternatively, the inner container 5B may be sealed during the assembly process by sandwiching the metal film 43 between the upper pressing part 30 and the flange 18F and pressing down the metal film 43 with the upper pressing part 30.

In this configuration, because the container body 1F includes a metal layer or an inorganic layer and the metal film 43 covering the entire upper surface of the container body 1F includes a metal layer, the double-wall container 200B can achieve the air shielding property.

The upper pressing part 30 includes a mouth 31, a shoulder part 32 which is an upper wall, and a peripheral wall 33 extending downward from the outer edge of the shoulder part 32. The shoulder part 32 of the upper pressing part 30 presses the flange 18F and the metal film 43 from above.

The peripheral wall 33 of the upper pressing part 30 holds the flange 18 of the inner container 5B, the metal film 43, and the flange 705 of the side wall 701 of the outer container 7B from the outer side and thereby fits them together.

In this configuration, the container body 1F and the metal film 43 enable the content contained in the double-wall container 200B to be surrounded by an air barrier layer in all directions. Therefore, the upper pressing part 30 is not necessarily formed of a material (e.g., a metal) having an air barrier property as long as the upper pressing part 30 is formed of a strong material having a shape retaining property and can provide protection against an external impact. For example, similarly to the outer container 7B, the upper pressing part 30 may be formed of a material including a plastic or a resin such as polyethylene (PE), polypropylene (PP), or polyethylene terephthalate (PET).

With the metal film 43 attached until immediately before use, the inside of the container body 1 can be maintained in an oxygen-free state. When the container is used, the discharge mechanism 50 is attached, and the metal film 43 in the bottom of the mouth 31 is broken.

In FIG. 9, the shoulder part 22 of the lid 20 rises toward the center. However, the lid may have a flat shape like the shoulder part 32 of the upper pressing part 30 illustrated in FIG. 8 and FIG. 10. On the contrary, although the shoulder part 32 of the upper pressing part 30 in FIG. 8 and FIG. 10 has a flat shape, the shoulder part 32 may have a shape that rises toward the center like the shoulder part 22 of the lid 20 in FIG. 9.

In the double-wall containers of FIGS. 8 through 10, the inner container 5 including the container body 10 and the lid 20 is preferably detachably attached to the outer container 7. With this configuration, when the inner container 5 becomes empty or the amount of the liquid in the inner container 5 becomes small, the inner container 5 can be replaced with a new inner container filled with a liquid. Also, the upper fixing part 8, the fastener 90, or the upper pressing part 30 can continue to be used. Further, when the inner container becomes empty or the amount of the liquid in the inner container becomes small, the inner container may be detached from the outer container, refilled with a liquid, and then attached again to the outer container 7.

Each of the double-wall containers illustrated in FIGS. 8 through 10 is an example of a multi-wall container, and may be configured as a container having three or more walls by providing an additional container(s) outside of the double-wall container.

Example where Discharge Mechanism is Attached to Double-Wall Container

Figure 11:
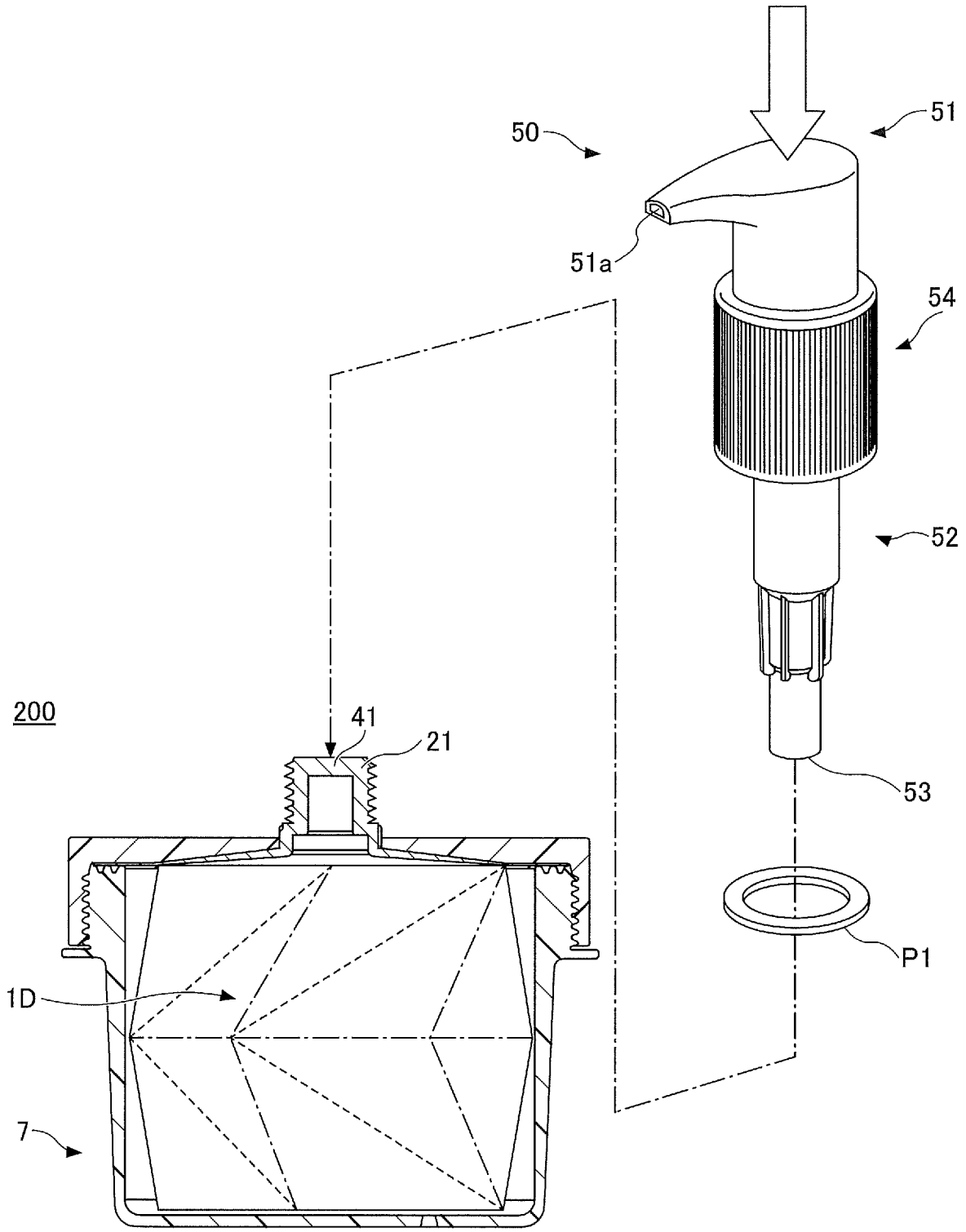
FIG. 11 is a drawing illustrating an example where a discharge mechanism is attached to a double-wall container.

FIG. 11 illustrates an example where a discharge mechanism is attached to a double-wall container. The configuration of the discharge mechanism is the same as that illustrated in FIG. 4. Although FIG. 11 illustrates an example where a discharge mechanism is attached to the double-wall container of FIG. 8, the double-wall container to which the discharge mechanism is attached may have a configuration illustrated in FIG. 9 or FIG. 10.

As illustrated in FIG. 11, with a configuration where the discharge mechanism 50 is attached to the double-wall container, when the amount of the content decreases, the container body 1D/1E/1F of the inner container 5/5A/5B shrinks, but the shape of the outer container 7/7A/7B does not change.

For the double-wall container, the type of a discharge mechanism may be selected depending on the viscosity of the content contained in the inner container 5/5A/5B. For example, the discharge mechanism is not limited to a dispenser-type airless pump as illustrated in FIG. 11, and may also be a wide-diameter pump head or a pump head with a saucer.

Preferred embodiments of the present invention are described in detail above. However, the present invention is not limited to the specifically disclosed embodiments, and variations and modifications may be made without departing from the scope of the present invention described in the claims.

The present application is based on and claims priority to Japanese Patent Application No. 2018-113138 filed on Jun. 13, 2018, the entire contents of which are hereby incorporated herein by reference.

EXPLANATION OF REFERENCE NUMERALS

1, 1C, 1D, 1E, 1F container body
2 mouth-side part
3 pump
4 pressing head
5, 5A, 5B inner container
6 mouth (inner lid)
7, 7A, 7B outer container
8 upper fixing part
9 fastener
10 side wall
17 bottom wall (lower wall)
18,18F flange
20, 20C lid

21, 21C mouth
22, 22C shoulder part
30 upper pressing part
41, 42 closing film
43 metal film
50 discharge mechanism
70 cap
90 fastener
100, 100A, 100B, 100C container
110 side wall
120 bottom wall
130 upper wall
140 mouth
200, 200A, 200B double-wall container
S1, S2, S3, S4 unit

The invention claimed is:

1. A container, comprising:
a closing film;
an upper wall including a mouth
a bottom wall; and
a side wall, wherein
multiple vertically-crushable units are formed in the side wall,
each unit of the multiple units includes mountain fold lines formed by sides of parallelograms and valley fold lines formed by diagonal lines of the parallelograms,
the multiple units are stacked in tiers such that each pair of the parallelograms in upper and lower tiers have a common lower/upper side and the parallelograms in the upper and lower tiers alternately become line-symmetrical with respect to the common lower/upper side,
a material thickness of the side wall is thinner at mountain fold side wall portions and valley fold side wall portions of the side wall, the mountain fold side wall portions and the valley fold side wall portions respectively corresponding to areas where the mountain fold lines and the valley fold lines are formed in the side wall,
the upper wall is closely attached to a portion near an upper end of the side wall, and
the closing film is formed as a monolithic structure with the mouth included in the upper wall, and the closing film closes off the mouth.

2. The container as claimed in claim 1, wherein in the side wall,
the each unit has a hollow polygonal shape formed by connecting lateral sides of the parallelograms to each other, and
each of the diagonal lines of the each unit is a diagonal line that equally divides acute angles of a corresponding one of the parallelograms.

3. The container as claimed in claim 1, wherein
outer edges of the upper wall and the bottom wall are formed to have a repeated polygonal shape.

4. The container as claimed in claim 1, wherein each of the side wall and the bottom wall includes a metal layer or a layer on which an inorganic substance is deposited, the metal layer and the layer having an air shielding property.

5. The container as claimed in claim 1, wherein the side wall and the bottom wall include a resin.

6. The container as claimed in claim 4, wherein the side wall and the bottom wall are formed as a monolithic structure.

7. The container as claimed in claim 6, wherein a discharge pump is attached to the mouth, the discharge pump being configured to discharge a content contained in the container and to prevent air from flowing into the container when the content is discharged.

8. A multi-wall container, comprising:
the container as claimed in claim 1; and
an outer container that covers outer sides of the side wall and the bottom wall of the container used as an inner container.

9. The container as claimed in claim 1, wherein the closing film includes a metal layer or an inorganic layer.

10. The container as claimed in claim 8, wherein the metal layer includes a metal selected from the group consisting of aluminum, iron, gold, silver, titanium, tin, zinc, platinum, ruthenium, palladium, iridium, alloys thereof, and oxides thereof deposited on a plastic sheet.

11. The container as claimed in claim 8, wherein the inorganic layer includes silicon oxide deposited on a plastic sheet.

* * * * *